US006886916B1

(12) United States Patent
Galambos et al.

(10) Patent No.: US 6,886,916 B1
(45) Date of Patent: May 3, 2005

(54) PISTON-DRIVEN FLUID-EJECTION APPARATUS

(75) Inventors: Paul C. Galambos, Albuquerque, NM (US); Gilbert L. Benavides, Los Ranchos, NM (US); Bernhard Jokiel, Jr., Albuquerque, NM (US); Jerome F. Jakubczak II, Rio Rancho, NM (US)

(73) Assignee: Sandia Corporation, Albuquerque, NM (US)

( * ) Notice: Subject to any disclaimer, the term of this patent is extended or adjusted under 35 U.S.C. 154(b) by 56 days.

(21) Appl. No.: 10/600,008

(22) Filed: Jun. 18, 2003

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS 5,501,893 A 3/1996 Laermer et al.
5,804,084 A 9/1998 Nasby et al.
5,862,003 A 1/1999 Saif et al.
6,133,670 A 10/2000 Rodgers et al.
6,175,170 B1 1/2001 Kota et al.
6,318,841 B1 * 11/2001 Coleman et al. ..... 347/44
6,350,015 B1 2/2002 Gooray et al.
6,357,865 B1 3/2002 Kubby et al.
6,364,460 B1 4/2002 Sager
6,367,915 B1 4/2002 Gooray et al.
6,406,130 B1 6/2002 Gooray et al.
6,409,311 B1 6/2002 Gooray et al.
6,416,169 B1 7/2002 Gooray et al.
6,419,335 B1 7/2002 Gooray et al.
6,443,179 B1 9/2002 Benavides et al.
6,472,332 B1 10/2002 Gooray et al.
6,505,912 B2 1/2003 Silverbrook et al.
6,507,138 B1 1/2003 Rodgers et al.
6,548,895 B1 4/2003 Benavides et al.
2004/0036741 A1 * 2/2004 Delametter et al.

* cited by examiner

*Primary Examiner*—Raquel Yvette Gordon
(74) *Attorney, Agent, or Firm*—John P. Hohimer

(57) ABSTRACT

A surface-micromachined fluid-ejection apparatus is disclosed which utilizes a piston to provide for the ejection of jets or drops of a fluid (e.g. for ink-jet printing). The piston, which is located at least partially inside a fluid reservoir, is moveable into a cylindrical fluid-ejection chamber connected to the reservoir by a microelectromechanical (MEM) actuator which is located outside the reservoir. In this way, the reservoir and fluid-ejection chamber can be maintained as electric-field-free regions thereby allowing the apparatus to be used with fluids that are electrically conductive or which may react or break down in the presence of a high electric field. The MEM actuator can comprise either an electrostatic actuator or a thermal actuator.

42 Claims, 11 Drawing Sheets

Section 2 - 2

Section 1 - 1

Section 2 - 2

PISTON-DRIVEN FLUID-EJECTION APPARATUS

GOVERNMENT RIGHTS

This invention was made with Government support under Contract No. DE-AC04-94AL85000 awarded by the U.S. Department of Energy. The Government has certain rights in the invention.

FIELD OF THE INVENTION

The present invention relates in general to microelectromechanical devices and in particular to a surface-micromachined piston-driven fluid-ejection apparatus that has many applications for the deposition of fluids in jet or droplet form, including inkjet printing.

BACKGROUND OF THE INVENTION

Fluid ejectors have been developed for ink-jet printing. Many different and varied designs of fluid ejectors have been developed in the prior art. Of particular interest are fluid ejectors that can be fabricated using micromachining which allows batch fabrication without piece-part assembly thereby potentially reducing manufacturing costs. Examples of fluid ejectors formed by micromachining can be found in U.S. Pat. Nos. 6,350,015; 6,357,865; 6,364,460; 6,367,915; 6,406,130; 6,409,311; 6,416,169; 6,419,335; 6,472,332; and 6,505,912, each of which is incorporated herein by reference.

A disadvantage of many of the types of fluid ejectors disclosed in the above patents is that these fluid ejectors rely on a high internal electric field for ejection of the fluid (i.e. the fluid is exposed to a high electric field); and this limits the types of fluids that can be used to those types of fluids which are not electrically conductive and which are not chemically alterable in the presence of an electric field.

The present invention provides a surface-micromachined fluid-ejection apparatus (i.e. a fluid ejector) wherein the fluid is not exposed to any electric field prior to ejection thereof, and thereby allowing the use of many different types of fluids including electrically-conductive fluids, multi-component fluids, fluids containing electrically-conductive solid particles, and fluids which undergo an unwanted chemical reaction in the presence of an electric field, etc.

The present invention also provides a fluid ejector in which a force and/or displacement used to eject a jet or drop of a particular fluid can be controlled and varied, thereby allowing the fluid ejector of the present invention to be used with a wide range of fluids of different viscosity, and further allowing the amount of fluid ejected to be controlled and varied to produce droplet sizes in the range of less than one femtoliter to picoliters or larger.

In certain embodiments of the present invention, two or more different fluids can be mixed or combined immediately prior to ejection thereof to provide an ejecta having characteristics not heretofore possible with conventional fluid ejection devices.

Embodiments of the present invention can be provided with different types of microelectromechanical (MEM) actuators including electrostatic comb actuators, capacitively-coupled electrostatic plate actuators and thermal actuators.

These and other advantages of the present invention will become evident to those skilled in the art.

SUMMARY OF THE INVENTION

The present invention relates to a surface-micromachined fluid-ejection apparatus comprising a substrate (e.g. a silicon substrate); an open-ended cylindrical fluid-ejection chamber formed on the substrate and further comprising a plurality of stacked and patterned layers of polycrystalline silicon, with the fluid-ejection chamber being adapted to receive a fluid, and with the fluid-ejection chamber further having a fluid-ejection orifice formed through a wall thereof at a location distal to an open end of the fluid-ejection chamber; and a piston formed on the substrate and moveable in the plane of the substrate from a first position outside the fluid-ejection chamber to a second position inside the fluid-ejection chamber to eject a jet or drop of the fluid through the fluid-ejection orifice. A microelectromechanical (MEM) actuator can be formed on the substrate and operatively connected to move the piston between the first and second positions.

The fluid-ejection orifice generally has a diameter of 50 microns or less, with the exact size of the fluid-ejection orifice depending upon various factors including the application of the device, the viscosity of the fluid, the quantity of the fluid to be ejected, whether the fluid is to be ejected as a jet or drop, the displacement of the piston, etc.

The MEM actuator can comprise an electrostatic actuator or a thermal actuator. The electrostatic actuator can be, for example, a bidirectional electrostatic actuator (i.e. an electrostatic actuator capable of moving in two opposite directions at different times). Alternately the MEM actuator can be used to move the piston in one direction (e.g. to eject the fluid), and another MEM actuator can be used to move the piston in an opposite direction (e.g. to retract the piston after ejection of the fluid). The thermal actuator can be a bent-beam thermal actuator which can be heated by passing an electrical current therethrough to move the piston in one direction (e.g. to eject the fluid) and can be cooled by removing the electrical current to move the piston in the opposite direction (e.g. to retract the piston).

A fluid reservoir can be provided in the fluid-ejection apparatus, with the fluid reservoir being in fluidic communication with the fluid-ejection chamber for providing the fluid thereto. The fluid-ejection chamber can be provided with an opening through a sidewall thereof to provide a pathway for the fluid to enter the fluid-ejection chamber. This can be done, for example, by making the sidewall hollow so that it forms a fluid communication channel between the fluid reservoir and the fluid-ejection chamber. One or more fluid fill ports can be formed through the substrate to supply the fluid to the fluid reservoir.

The piston, which can comprise polycrystalline silicon, is generally located at least partially inside the fluid reservoir with a part of the piston or a linkage penetrating through an opening in a sidewall of the fluid reservoir to connect the piston to the MEM actuator. The MEM actuator, which is used to move the piston back and forth, is located entirely outside the fluid reservoir. This is advantageous for providing the fluid-ejection chamber as an electric-field-free region, with the piston and fluid-ejection chamber both being maintained at a ground electrical potential during ejection of the jet or drop of the fluid.

Various options are available in different embodiments of the present invention to limit or control any leakage of the fluid through the opening in the sidewall of the fluid reservoir. As an example, the opening in the sidewall of the fluid reservoir can include an indentation opposite each side of the linkage to provide a gas-bubble seal between the linkage and the fluid reservoir to limit any leakage of the fluid through a gap separating the linkage and the opening in the sidewall of the fluid reservoir. As another example, any leakage of the fluid through the gap separating the linkage and the opening in the sidewall of the fluid reservoir can be collected. This can be done by providing one or more ducts extending outward from the gap for conducting any leakage of the fluid away from the gap. The ducts can empty into a fluid evacuation port formed through the substrate, or into a fluid evaporation tank formed on the substrate.

The present invention further relates to a surface-micromachined fluid-ejection apparatus comprising a substrate; an open-ended fluid-ejection chamber formed on the substrate from a plurality of stacked and patterned layers of polycrystalline silicon, with the fluid-ejection chamber being adapted to receive a fluid, and with the fluid-ejection chamber further having a fluid-ejection orifice formed through a wall thereof; a fluid reservoir formed on the substrate from the plurality of stacked and patterned layers of polycrystalline silicon and connected to the fluid-ejection chamber to supply the fluid thereto; a piston formed on the substrate and moveable in the plane of the substrate to eject a jet or drop of the fluid through the fluid-ejection orifice; and at least one microelectromechanical (MEM) actuator formed on the substrate and operatively connected to provide reciprocating motion to the piston, with the MEM actuator being formed outside the fluid reservoir and outside the fluid-ejection chamber. The substrate can comprise silicon; and the piston can comprise polycrystalline silicon.

In certain embodiments of the present invention, a fluidic connection between the fluid reservoir and the fluid-ejection chamber can be provided through the piston. This can be done, for example, by providing the fluidic connection through a hollow portion of the piston, with a flapper valve being formed within the piston to limit flow of the fluid to a single direction (i.e. into the fluid-ejection chamber). In other embodiments of the present invention, the fluidic connection can be provided through a hollow sidewall of the fluid-ejection chamber, or through a spacing between the piston and an open end of the fluid-ejection chamber when the piston is in a retracted position, or both.

A mechanical connection between the MEM actuator and the piston can be made through an opening in the sidewall of the fluid reservoir. This opening can further include a gas-bubble seal to limit any leakage of the fluid from the reservoir, with the gas-bubble seal being formed from an indentation opposite each side of the linkage. Any leakage of the fluid can further be collected by one or more ducts which extend outward from the gap to conduct the leakage away from the gap. The ducts can either empty into a fluid evacuation port formed through the substrate, or into a fluid evaporation tank formed on the substrate.

The present invention is also related to a surface-micromachined fluid-ejection apparatus comprising a substrate; an open-ended fluid-ejection chamber formed on the substrate, with the fluid-ejection chamber forming an electric-field-free region whereby a fluid disposed therein is not contacted by any electric field produced by the apparatus, and with the fluid-ejection chamber further having a micron-sized fluid-ejection orifice formed through a top wall thereof; a fluid reservoir formed on the substrate and connected to the fluid-ejection chamber to supply the fluid thereto; a piston formed on the substrate and moveable in the plane of the substrate to eject a portion of the fluid through the fluid-ejection orifice; and at least one microelectromechanical (MEM) actuator formed on the substrate outside the fluid reservoir and operatively connected to provide reciprocating motion to the piston. The substrate can comprise monocrystalline silicon, and each of the fluid-ejection chamber, the fluid reservoir, the piston and the MEM actuator can comprise polycrystalline silicon.

The piston can be connected to the MEM actuator by a linkage which penetrates through an opening in a sidewall of the fluid reservoir, with the opening optionally including an indentation opposite each side of the linkage to provide a gas-bubble seal to limit any leakage of the fluid through the opening. Other means for collecting any leakage of the fluid through a gap separating the linkage and the opening in the sidewall of the fluid reservoir are possible. For example, one or more ducts can be provided in the apparatus extending outward from a gap between the linkage and the opening in the fluid reservoir to conduct the leakage away from the gap, with the ducts emptying into a fluid evacuation port formed through the substrate, or into a fluid evaporation tank formed on the substrate.

Additional advantages and novel features of the invention will become apparent to those skilled in the art upon examination of the following detailed description thereof when considered in conjunction with the accompanying drawings. The advantages of the invention can be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several aspects of the present invention and, together with the description, serve to explain the principles of the invention. The drawings are only for the purpose of illustrating preferred embodiments of the invention and are not to be construed as limiting the invention. In the drawings.

DETAILED DESCRIPTION OF THE INVENTION

Figure 1:
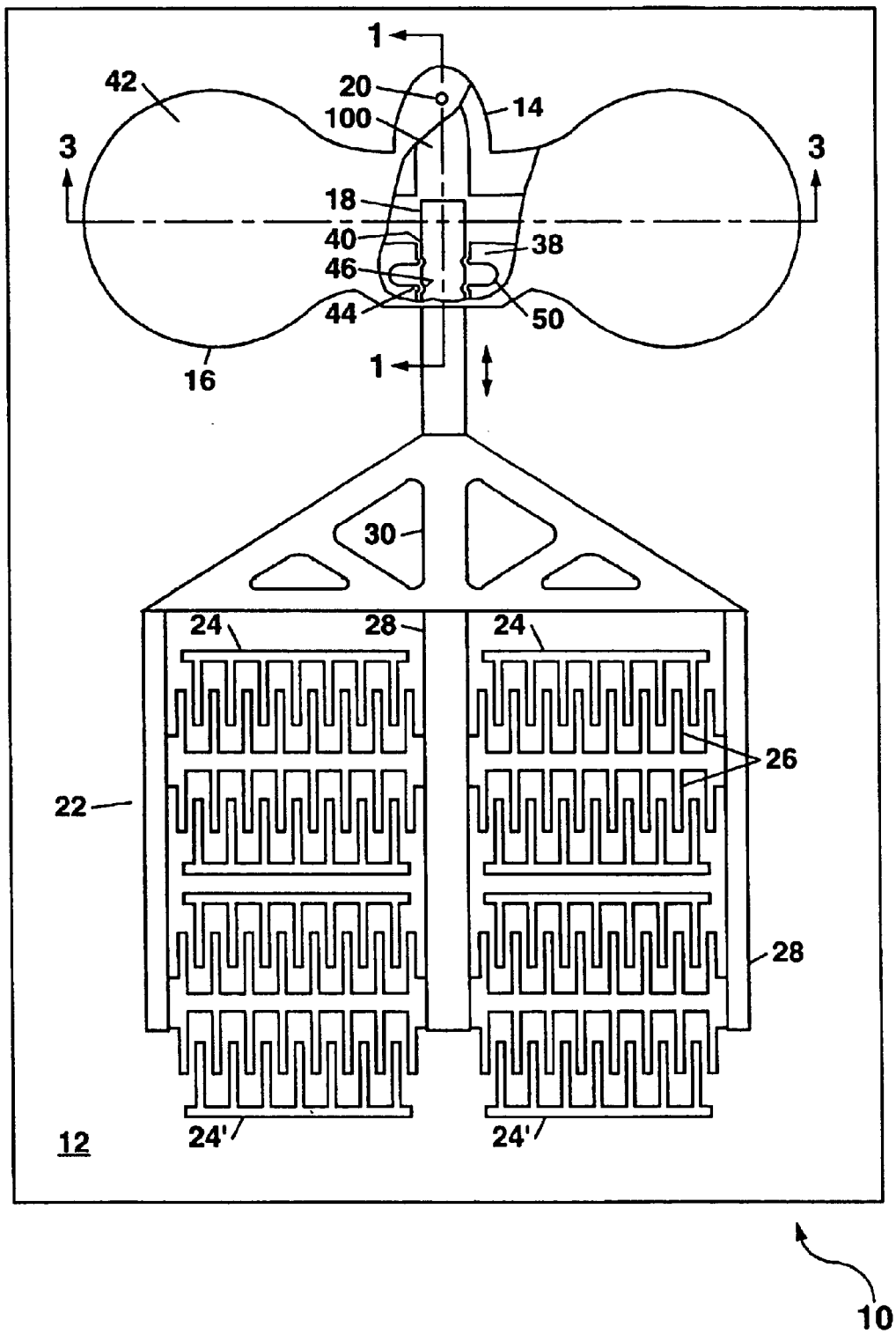
FIG. 1 shows a schematic plan view of a first example of the fluid-ejection apparatus of the present invention with a partial cutaway view to show elements of the apparatus including the piston, the fluid-ejection chamber and an indentation on each side of a sidewall opening through the fluid reservoir wherein a gas-bubble seal can be formed to limit any leakage of the fluid from the reservoir during operation of the apparatus.

Referring to FIG. 1, there is shown a schematic plan view of a first example of the surface-micromachined fluid-ejection apparatus 10 of the present invention, including a partial cutaway view showing certain elements of the apparatus 10 as will be described hereinafter. In FIG. 1, the apparatus 10 comprises a substrate 12, an open-ended cylindrical fluid-ejection chamber 14 formed on the substrate 12 for receiving a fluid 100 from a fluid reservoir 16, and a piston 18 which is moveable into the fluid-ejection chamber 14 to eject a portion 110 of the fluid 100 as a jet or drop through a micron-sized fluid-ejection orifice 20. The fluid 100 prior to ejection of the portion 110 thereof is not exposed to any electric field since a MEM actuator 22 used to move the piston 16 back and forth is located outside the fluid reservoir 16, with the fluid reservoir 16 generally being maintained at ground electrical potential. Also, the fluid 100 need not be exposed to an elevated temperature during operation of the apparatus 10 since no heating of the fluid 100 is produced by the MEM actuator 22 which does not physically contact the fluid 100 (except via the piston 18).

The term "cylindrical" as used herein to refer to the fluid-ejection chamber 14 should not be read to imply that the fluid-ejection chamber 14 is necessarily cylindrically-shaped, but is intended to refer to a chamber 14 which is elongate with an arbitrary cross-section shape (including rectangular or square) and with one end open and an opposite end being closed except for the fluid-ejection orifice 20 and arbitrarily-shaped (e.g. rounded, tapered, trapezoidal, square, etc.). The term "micron-sized orifice" as used herein refers to an orifice 20 having lateral dimensions of up to a few tens of micrometers, and generally in the range of 2–50 $\mu$m.

In FIG. 1, the substrate 12 generally comprises monocrystalline silicon; and the various elements on the substrate 12 (i.e. fluid-ejection chamber 14, the fluid reservoir 16, the piston 18 and the actuator 22) can be built up from a plurality of deposited and patterned layers of polycrystalline silicon (also termed polysilicon) using surface micromachining which is based on conventional integrated circuit (IC) processing technology.

In FIG. 1, the MEM actuator 22 is shown as an electrostatic comb actuator 22 which comprises a plurality of stationary electrostatic combs 24 attached to the substrate 12 and a plurality of moveable electrostatic combs 26 suspended above the substrate 12 on springs (not shown) which can be folded and located underneath the frame 28 and the moveable electrostatic combs 26. Each comb 24 and 26 comprises a plurality of spaced fingers extending outward therefrom. A truss 30 can be attached to the frame 28 to couple the electrostatic comb actuator 22 to the piston 18.

Figure 2:
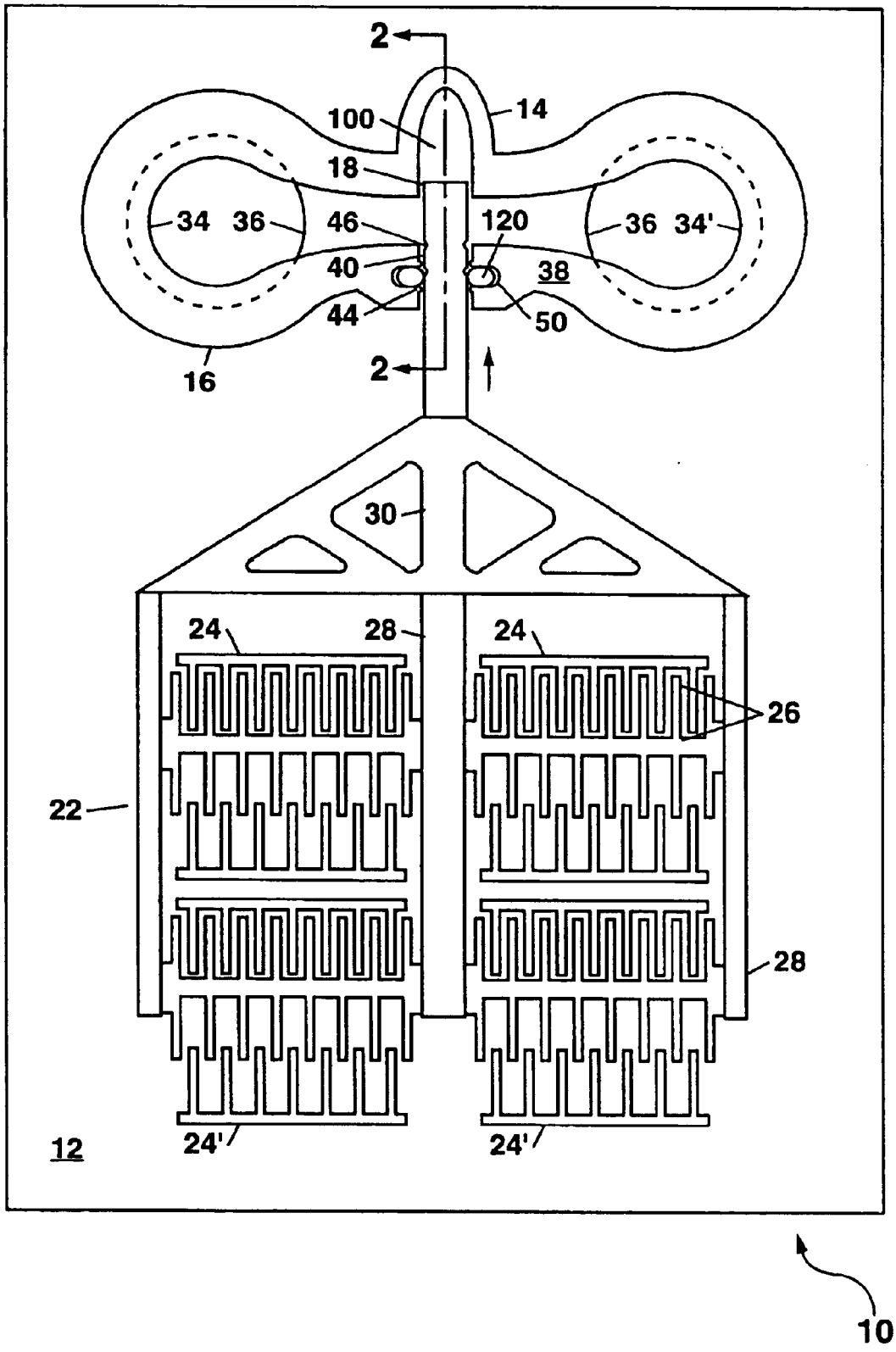
FIG. 2 shows a schematic plan view of the device of FIG. 1 with a top wall of the fluid reservoir and of the fluid-ejection chamber removed to show further details of the reservoir including a pair of fluid fill ports formed through the substrate, and to show movement of the piston into the fluid-ejection chamber produced by operation of an electrostatic comb actuator.
Figure 3A:
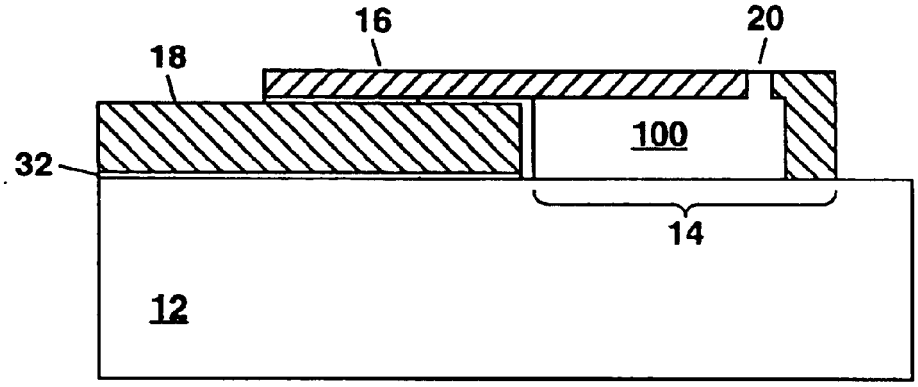
FIGS. 3A and 3B, which are schematic cross-section views along the section lines 1—1 and 2—2 in FIGS. 1 and 2, respectively, illustrate operation of the device to move the piston into the fluid-ejection chamber thereby ejecting a jet or drop of the fluid from the apparatus.
Figure 3B:
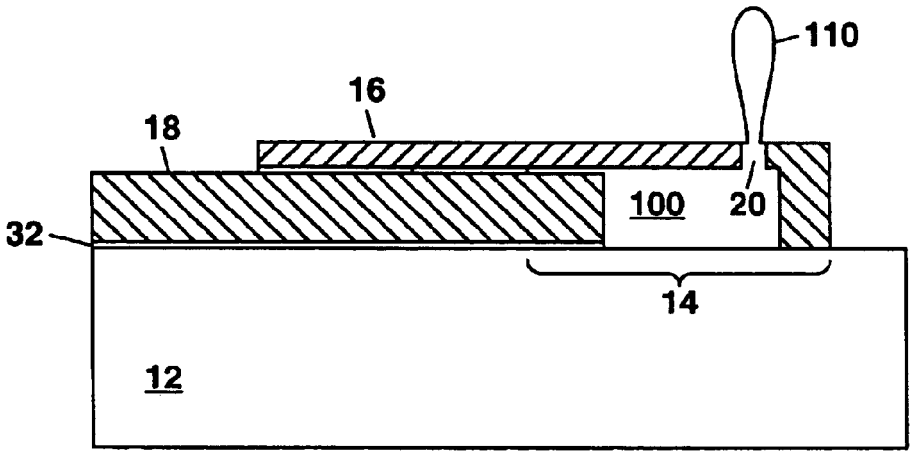

In FIG. 1, the electrostatic comb actuator 22 is shown as a bidirectional actuator 22 having a first set of stationary electrostatic combs 24 located on one side of the moveable electrostatic combs 26 and a second set of stationary electrostatic combs 24' located on the other side of the moveable electrostatic combs 26. This arrangement allows each set of the stationary electrostatic combs 24 and 24' to be electrically activated independently, with the moveable electrostatic combs 26 held at ground electrical potential, to move the frame 28 and truss 30 in one direction or the other as indicated by the double-headed arrow in FIG. 1. Thus, electrical activation of the first set of the stationary electrostatic combs 24 will move the piston 18 forward into the fluid-ejection chamber 14 as shown in FIGS. 2 and 3B to eject a portion 110 of the fluid 100 through the orifice 20. Electrical activation of the second set of the stationary electrostatic combs 24' can then be used to retract the piston 18 from the fluid-ejection chamber 14.

The electrical actuation in each direction can be performed using an applied voltage generally in the range of 5–200 Volts applied to the MEM actuator 22 through a plurality of bond pads and wiring (not shown) formed on the substrate 12, The exact voltage to be applied to the actuator 22 in FIG. 1 will depend upon a number of factors including the design of the electrostatic actuator 22, the size and required displacement of the piston 18, the viscosity of the fluid 100, etc. The bidirectional electrostatic comb actuator 22 in FIGS. 1 and 2 can be operated with a pulsed or square wave voltage applied to the stationary electrostatic combs 24 and 24' to provide a reciprocating motion to the piston 18 thereby ejecting a plurality of jets or drops of the fluid 100 in rapid succession.

Those skilled in the art will understand that electrostatic actuators operate by producing an electrostatic force of attraction which urges the stationary and moveable electrostatic combs towards each other thereby producing a mechanical force and displacement at an output of the actuator which can be used to move an object connected thereto.

In FIG. 2, the applied voltage, which is provided to the first set of the stationary electrostatic combs 24 via electrical wiring (not shown) on the substrate 12 with the moveable electrostatic combs 26 being electrically grounded through the springs which are preferably electrically conductive (e.g. using polysilicon doped with boron or phosphorous), urges the combs 24 and 26 towards each other thereby moving the piston 18 from an initial position outside the fluid-ejection chamber 14 to a final position inside the chamber 14. Note that a top wall 42 covering the fluid reservoir 16 and the fluid-ejection chamber 18 has been omitted in FIG. 2 to show additional details of the structure of the first example of the apparatus 10 of the present invention.

In FIG. 2, the displacement of the piston 18 into the fluid-ejection chamber 14 ejects a portion 110 of the fluid 100 through the orifice 20 as a jet or drop of the fluid 100. This operation of the device 10 is illustrated in FIGS. 3A and 3B which represent schematic cross-section views along the section lines 1—1 and 2—2 in FIGS. 1 and 2, respectively.

The exact displacement of the piston 18 can adjusted to control the size of the ejected portion 110, which further depends upon the size of the orifice 20. This can be done by controlling the magnitude or the time duration or both of the voltage applied to the MEM actuator 22.

After ejection of a predetermined portion 110 of the fluid 100 from the apparatus 10, the piston 18 can be retracted from the chamber 14 to refill the chamber 14 with additional fluid 100 and to prepare for the ejection of an additional jet or drop of the fluid 100. This can be done by removing the applied voltage from the first set of the stationary electrostatic combs 24 and applying the same or a different voltage to the second set of the stationary electrostatic combs 24'.

In other embodiments of the present invention, an electrostatic actuator 22 having only one set of stationary electrostatic combs (i.e. a unidirectional electrostatic actuator comprising only the first set of the stationary electrostatic combs 24 used in combination with the moveable electrostatic combs 26) can be used, with the retraction of the piston 18 being performed by a restoring force provided by the springs in the actuator 22. The use of a bidirectional electrostatic actuator having the second set of stationary electrostatic combs 24' as shown in FIGS. 1 and 2 can be advantageous, however, to effect a more abrupt retraction of the piston 18 than would be possible by relying on the springs alone for retraction. An abrupt retraction of the piston 18 can be advantageous to separate the ejected portion 110 from the remainder of the fluid 100 in the chamber 14 and thereby facilitate drop formation, especially when the drops to be formed are relatively small, or when the fluid 100 is viscous or has a low surface tension.

Figure 4:
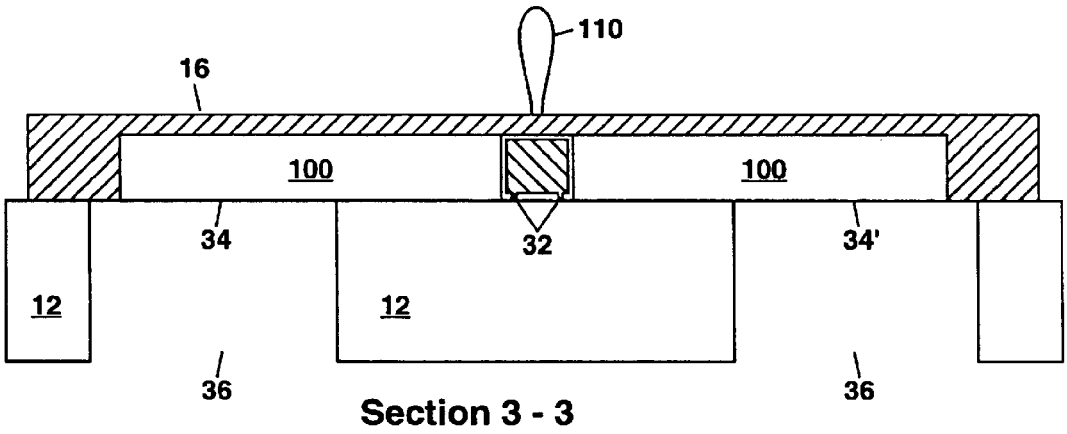
FIG. 4 shows a schematic cross-section view along the section line 3—3 in FIG. 1 to illustrate additional details of the apparatus, including the fluid reservoir and a pair of fluid fill ports formed through the substrate.

Additional details of the first example of the present invention can be seen in FIG. 4 which shows a schematic cross-section view along the section line 3—3 in FIG. 1. In FIG. 4, the piston 18 can include one or more dimples 32 on a bottom surface thereof (and optionally on other surfaces of the piston 18 or on an underside of the top wall 42 of the fluid reservoir 16) to reduce friction or adhesion of the piston 18 to any surfaces with which the piston 18 can come into contact. The dimples 32, which can be about 0.5 $\mu$m high, can extend along a portion or the entirety of the length of the piston 18.

In FIG. 4, the reservoir 16 comprises two lobes 34 and 34' each of which can be used to provide the fluid 100 to the fluid-ejection chamber 14. Alternately, each lobe 34 and 34' can be used to provide a different fluid 100 to the fluid-ejection chamber 14 to form a multi-component ejected portion 110. This can be advantageous, for example, to deposit a multi-component ejected portion 110 which undergoes a chemical reaction immediately prior to or after ejection through the orifice 20 to form a composition which could not otherwise be easily deposited on the microscopic scale. In other embodiments of the present invention, a plurality of lobes 34 can be provided in the reservoir 16 so that a plurality of fluids 100 can be ejected through a common orifice 20 in the apparatus 10. This capability will allow many potential new applications not heretofore possible using conventional microscopic fluid ejectors.

These potential applications include the selective patterned deposition of a single-part or multi-part adhesive on a surface for the microassembly of component parts thereon; the fabrication of two- or three-dimensional structures on a microscopic scale from rapidly-curing solutions including polymers and adhesives; the coating of chemical sensors and sensor arrays (e.g. chemiresistors or surface acoustic wave sensors) with one or more chemically-selective materials (e.g. to form selectively adsorbing or absorbing regions thereon); the deposition of biological materials (including DNA, RNA, protein solutions, base pair solutions, etc.) at volumes smaller than is currently possible with dip pen systems for analysis or synthesis; the formation of polymer electronic circuits by the deposition of electrically conducting, insulating and semi-conductive polymers on a substrate; the deposition of "smart" materials for meso-scale self-assembly; the ejection of encapsulated particles (e.g. a gas, liquid or solid material encapsulated within a liquid shell); the deposition of foam or aerogel materials with a quantity of a gas being incorporated within a shell of a foam- or aerogel-forming material. Other applications of the fluid-ejection apparatus 10 will become evident to those skilled in the art upon practice of the present invention.

In FIG. 4, a fluid fill port 36 is provided through the substrate 12 to each lobe 34 and 34' of the fluid reservoir 16. Each fluid fill port 36 allows the same or a different fluid 100 to be provided to the apparatus 10. The fluid(s) 100 can be provided to the apparatus 10 using microcapillary tubing (not shown) which can be attached to a backside of the substrate 12 using an adhesive. Alternately, the substrate 12 can be mounted in a microfluidic package to facilitate electrical and fluidic connections to be made to the apparatus 10. Examples of microfluidic packages which can be adapted for use in packaging of the apparatus 10 of the present invention are disclosed in U.S. Pat. Nos. 6,443,179 and 6,548,895 which are incorporated herein by reference.

The fluid in the reservoir 16 can be pressurized by an external pump (not shown) which provides the fluid 100 to the apparatus 10 from an external source (i.e. a supply reservoir). In some embodiments of the present invention, the fluid reservoir 16 can include a flapper valve (not shown) above each fluid fill port 36 in the reservoir 16 to provide a one-way flow of the fluid 100 into the reservoir 16, or to keep the fluid 100 therein pressurized. Each flapper valve can be formed from one or more of the polysilicon layers.

Returning to FIG. 1, penetration of the piston 18 through an opening in a sidewall 38 of the fluid reservoir 16 generally requires some means to limit or contain a leakage of the fluid 100 through a gap 40 in the opening between the piston 18 and the sidewall 38 (i.e. a leakage control system). The gap 40 on either side of the piston 18 arises because of a fabrication tolerance (i.e. a minimum feature size) of the integrated circuit (IC) processes which are used in fabricating the apparatus 10. This fabrication tolerance is presently 1 $\mu$m (i.e. a 1 $\mu$m minimum feature size) for manufacture of the fluid-ejection apparatus 10 of the present invention. Those skilled in the art will understand that horizontal gaps 40 between the piston 18 and the substrate 12 and between the piston 18 and a top wall 42 of the fluid reservoir 16 can be made much smaller than the 1 $\mu$m minimum feature size if this is desired since the horizontal gaps 40 can be determined by material deposition or removal (e.g. by etching or chemical-mechanical polishing) which can be precisely controlled.

Figure 6:
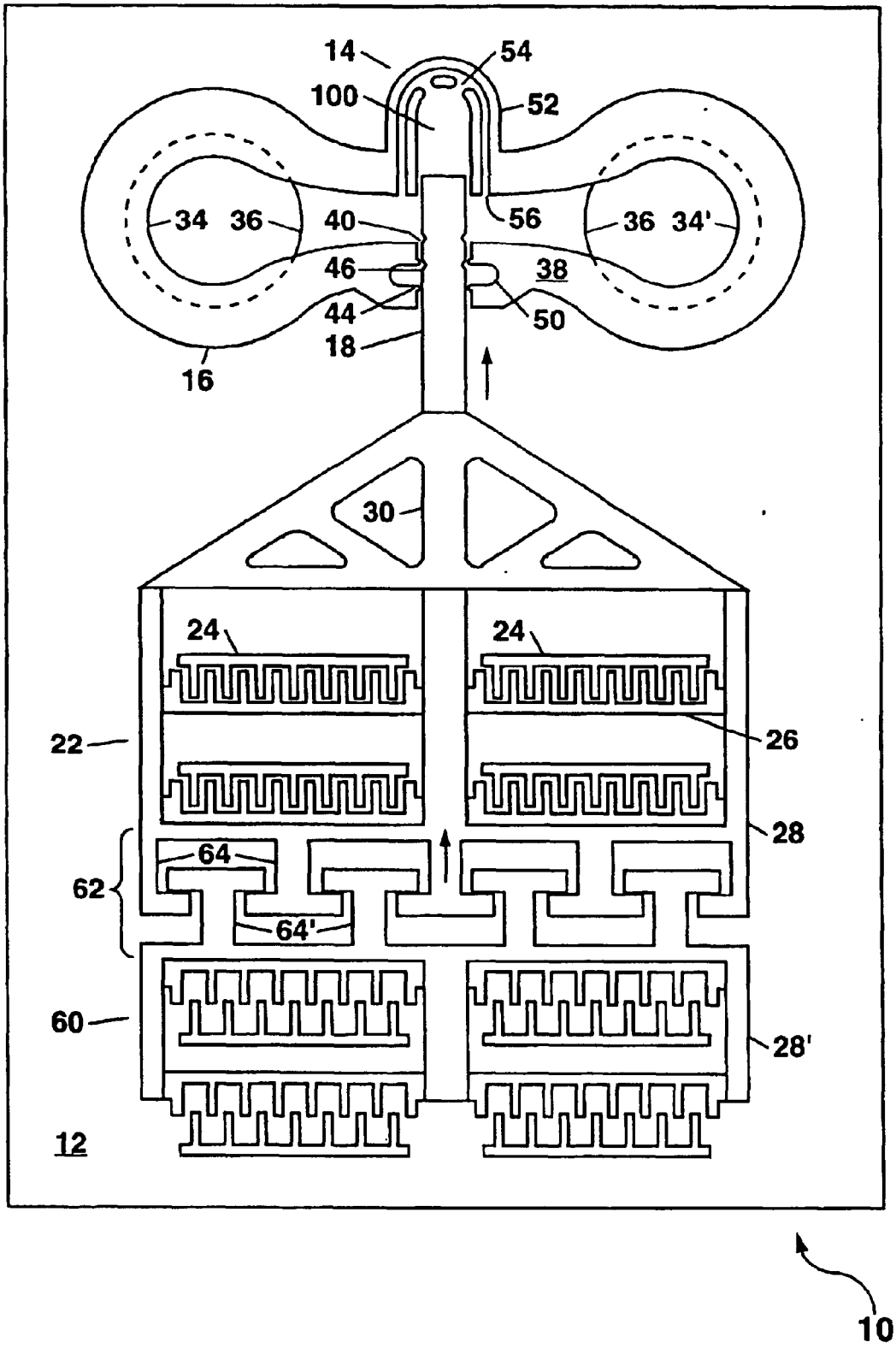
FIG. 6 illustrates operation of an electrostatic comb actuator in the apparatus of FIG. 5 to move the piston forward into the fluid-ejection chamber to eject a jet or drop of fluid therefrom.

Although the minimum feature size for the vertical gaps 40 is currently 1 $\mu$m, an effective separation between the piston 18 and the sidewalls 38 can be locally reduced well below this limit during operation of the apparatus 10. This can be done, for example, as shown in FIGS. 1 and 2 by forming a plurality of vertically-extending ridges 44 in the sidewall 38 and corresponding valleys 46 in the piston 18 (or in a linkage 48 connecting the piston 18 to the actuator 22 when the linkage 48 penetrates the sidewall 38 as shown in FIG. 6), or vice versa. In the as-fabricated device 10 as shown in FIG. 1, the ridges 44 and valleys 46 are initially aligned and separated by the 1 μm minimum feature size. However, when the piston 18 is moved forward or backward slightly, the ridges 44 and valleys 46 are displaced relative to each other as shown in FIG. 2 so that the resulting gap 40 can be locally much smaller than the minimum feature size, thereby limiting or reducing any leakage of the fluid 100 through the resulting gap 40.

Any leakage of the fluid 100 from the apparatus 10 can be further reduced by providing a gas-bubble seal 120 on each side of the piston 18 as shown in FIGS. 1 and 2. The gas-bubble seal 120 can be produced, for example, by forming an indentation 50 in the sidewall 38 opposite each side of the piston 18 (or opposite each side of a linkage 48 connecting the piston 18 to the actuator 22). The indentation 50 allows a quantity of air to be trapped between the piston 18 and the sidewall 38, with the air in combination with any leakage of the fluid 100 forming a gas bubble which fills the indentation 50 and forms the gas-bubble seal 120. The pressure in the gas bubble and the surface tension of the fluid 100 work together to create an area through which any further leakage of the fluid 100 cannot pass, thereby limiting any further leakage of the fluid 100 from the apparatus 10. Other systems for controlling and managing leakage of the fluid 100 from the apparatus 10 will be described hereinafter with reference to other examples of the apparatus 10 of the present invention.

The fluid-ejection apparatus 10 of FIG. 1 can be fabricated using conventional surface micromachining as known to the art. Surface micromachining involves a series of well-known semiconductor processing steps originally developed primarily for integrated circuits (IC), but which have been adapted to build up microelectromechanical (MEM) structures layer by layer. Using surface micromachining, the various structural elements of the apparatus 10 of FIG. 1 and any associated electrical wiring can be formed from a series of repeated deposition and patterning steps. Polycrystalline silicon and silicon nitride can be used to form the structural elements of the apparatus 10 in FIG. 1, together with a removable sacrificial material such as silicon dioxide or a silicate glass (e.g. TEOS which is used to refer to a silicate glass deposited from the decomposition of tetraethylortho silicate by low-pressure chemical vapor deposition at about 750° C. and densified by a high temperature processing) which is initially deposited to separate various elements of the apparatus 10 and which can be later removed in a selective etching step to release elements of the apparatus 10 for movement, or to form spaces between the elements and/or fluid channels or chambers therein. Altogether, a non-structural layer of polycrystalline silicon (also termed polysilicon) and four structural layers of polysilicon can be used to form the apparatus 10 in the example of FIG. 1.

The term "patterning" as used herein refers to a sequence of well-known semiconductor processing steps including applying a photoresist to the substrate 12, prebaking the photoresist, aligning the substrate 12 with a photomask, exposing the photoresist through the photomask, developing the photoresist, baking the wafer, etching away the surfaces not protected by the photoresist, and stripping the protected areas of the photoresist so that further processing can take place. The term "patterning" can further include the formation of a hard mask (e.g. comprising about 500 nanometers of TEOS) overlying a polysilicon or sacrificial material layer in preparation for defining features into the layer by etching.

To initiate the surface micromachining fabrication process used to construct the fluid-ejection apparatus 10 including the MEM actuator 22, a silicon substrate 12 can be initially coated with dielectric isolation films of low-pressure chemical vapor deposition (LPCVD) silicon nitride (about 8000 Å thick) over a thermal oxide (about 6300 Å thick). Each subsequently deposited and patterned layer of polysilicon or sacrificial oxide can be, for example, in the range of 0.3–2 μm thick, with the exact layer thickness depending upon the particular elements of the apparatus 10 to be fabricated from each layer of polysilicon, or to be separated by each layer of the sacrificial oxide.

A first patterned layer of polysilicon (termed Poly-0) is generally used to form electrical interconnections (e.g. wiring between a plurality of bond pads on the substrate 12 and the stationary and moveable electrostatic combs 24, 24' and 26 for providing the applied voltages thereto and for forming electrical ground planes underneath the moveable electrostatic combs 26, the frame 28 and the truss 30). The Poly-0 layer is generally not structural except when it is used to anchor additional overlying structural polysilicon layers to the substrate 12, the Poly-0 layer can be relatively thin (about 0.3 μm) and can be doped with phosphorous or boron for electrical conductivity. All polysilicon depositions used to fabricate the MEM apparatus 10 are LPCVD fine-grained polysilicon deposited at 580° C., and can additionally be doped for electrical conductivity as needed.

Four additional polysilicon layers (termed Poly-1, Poly-2, Poly-3 and Poly-4) can be used as mechanical (i.e. structural) layers to build up the structure of the fluid-ejection apparatus 10 in FIGS. 1–4, and various other examples of the apparatus 10 as described hereinafter. The various structural polysilicon layers can be stacked and laminated together or connected together at various points to build up the structure of the device 10. The Poly-1 layer can be 1.0 μm thick; the Poly-2 layer can be 1.5 μm thick; and the Poly-3 and Poly-4 layers can each be 2.25 μm thick. A thermal annealing step at an elevated temperature (e.g. 1100° C.) can be performed after deposition and patterning of each structural polysilicon layer to alleviate any residual stress therein, with each annealing step preferably being performed after first encapsulating that structural polysilicon layer within a blanket-deposited layer of the sacrificial material. Patterning of each structural polysilicon layer can involve masking and etching (e.g. reactive ion etching) to directly pattern that layer to define specific features therein for the various elements of the apparatus 10, or else blanket depositing the polysilicon into a mold formed by patterning an underlying layer of the sacrificial material, or both. Chemical-mechanical polishing (CMP) as known to the art (see U.S. Pat. No. 5,804,084 to Nasby, which is incorporated herein by reference) can be used to planarize each layer of deposited sacrificial material or polysilicon, as needed, to maintain a planar topography of the structure of the fluid-ejection apparatus 10 as it is being built up layer by layer.

Portions of the sacrificial material can be encapsulated within various of the polysilicon layers and retained therein after removal of the remaining sacrificial material using a selective wet etchant comprising hydrofluoric acid (HF). This can be done, for example, in forming the piston 18 which can be formed from the Poly-1 through Poly-3 layers with a 2-μm-thick layer of the sacrificial material being encapsulated between the Poly-2 and Poly-3 layers to provide added rigidity to the piston 18 which is generally about 7–8 μm high and 5–50 μm wide. Similarly, the sidewalls 38 of the fluid reservoir 16 and the fluid-ejection chamber 14 can be formed from the Poly-0 through Poly-3 layers with one or more layers of the sacrificial material permanently encapsulated therebetween; and with the top wall 42 of the fluid reservoir 16 and of the fluid-ejection chamber 14 being formed from the Poly-4 layer. The Poly-4 layer can also be patterned after deposition to form the fluid-ejection orifice 20.

The sacrificial material is also initially deposited within the fluid-ejection chamber 14, the lobes 34 and 34' of the reservior 16, the gaps 40 and the indentations 50 to define the shapes of these elements, but is subsequently removed to open up these elements the completed device 10 of FIGS. 1 and 2 and in the other examples of the apparatus 10 presented hereinafter. Similarly, the sacrificial material is used to initially support the moveable electrostatic combs 26, the frame 28 and the truss 30 of the bidirectional electrostatic comb actuator 22 during formation of these elements, with the sacrificial material being removed in the completed apparatus 10 to release these elements for movement, with the suspension of these elements above the substrate 12 being provided by the underlying springs.

The build-up of the actuator 22 proceeds at the same time as the remainder of the fluid-ejection apparatus 10, with the stationary electrostatic combs 24 and 24' being built up from the Poly-0 through Poly-4 layers and electrically insulated from the substrate 12 by the underlying silicon nitride layer which is initially formed on the substrate 12 as previously described. The moveable elements of the actuator 22 (i.e. the moveable electrostatic combs 26, the frame 28 and the truss 30) can be formed from the Poly-1 through the Poly-4 layers, with the underlying springs being formed in the Poly-1 and Poly-2 layers and attached to the substrate 12 using the Poly-0 layer which is also used to form electrical wiring on the substrate 12 to provide electrical connections thereto. Further details of bidirectional and unidirectional electrostatic comb actuators 22 suitable for use with the fluid-ejection apparatus 10 of the present invention can be found in U.S. Pat. No. 6,133,670 which is incorporated herein by reference.

Once the structure of the fluid-ejection apparatus 10 has been built up on a topside of the substrate 12, a final layer of the sacrificial material about 2 $\mu$m thick can be blanket deposited over the substrate 12 to encapsulate the structure in preparation for a final annealing step to relieve any stress in the various polysilicon layers.

The fluid fill ports 36 can then be formed through the substrate 12 from a backside thereof while the structure of the device 10 is encapsulated within the sacrificial material. This can be done, for example, by using a deep anisotropic plasma etching process as disclosed, for example, in U.S. Pat. No. 5,501,893 to Laermer which is incorporated herein by reference. This deep anisotropic plasma etching process combines multiple anisotropic etching steps with steps for simultaneously depositing an isotropic polymer/inhibitor to minimize lateral etching thereby allowing formation of the fluid fill ports 36 with straight sidewalls. This etching step can be terminated upon reaching the thermal oxide and silicon nitride layers on the substrate 12. The deep anisotropic plasma etching process can also be used to form the fluid-ejection orifice 20 through the substrate 12 in other embodiments of the present invention.

Once the structure of the fluid-ejection apparatus 10 in FIG. 1 has been built up, the device 10 must be released for operation. This is done by a release etch step which comprises selective etching to remove the sacrificial material that has been deposited during build-up of the structure of the apparatus 10. Exposed portions of the sacrificial material can be removed with the selective wet etchant comprising HF which dissolves away the exposed portions of the sacrificial material without chemically attacking the various polysilicon and silicon nitride layers or the substrate 12. Within the reservoir 16 and the fluid-ejection chamber 14, the sacrificial material can be removed through the fluid fill ports 36 after first etching through the thermal oxide and silicon nitride layers on the substrate 12 (e.g. by reactive ion etching). If needed, a plurality of micron-sized access openings (not shown) can be formed through the Poly-4 layer and various other polysilicon layers, as needed, to provide access to any underlying sacrificial material that needs to be removed for release of the apparatus 10. After removing the sacrificial material, these micron-sized access openings can be plugged with a deposited layer of silicon nitride. The release etch step can be performed by immersion over a period of several minutes to several hours.

Although the fluid-ejection orifice 20 is shown in FIG. 1 as being formed through a top wall 42 of the fluid-ejection chamber 14, in other embodiments of the present invention, the fluid-ejection orifice 20 can be formed through a sidewall of the fluid-ejection chamber 14, or a bottom wall of the chamber 14 with the term "bottom wall" being defined herein to include the substrate 12 and any layers deposited thereon to form a bottom of the fluid-ejection chamber 14 above which the fluid 100 is disposed. The formation of an orifice 20 through the bottom wall (e.g. through the substrate 12) is generally reserved for larger sized orifices 20 (e.g. 25–50 $\mu$m in diameter) and can be performed at the same time that the fluid fill ports 36 are formed through the substrate 12. The formation of an orifice 20 through the sidewall of the fluid-ejection chamber 14 can be formed during build-up of the structure of the fluid-ejection chamber 14 with the orifice 20 being filled with the sacrificial material during fabrication thereof, and with the sacrificial material later being removed by the selective wet etching step to open up the orifice 20.

Figure 5:
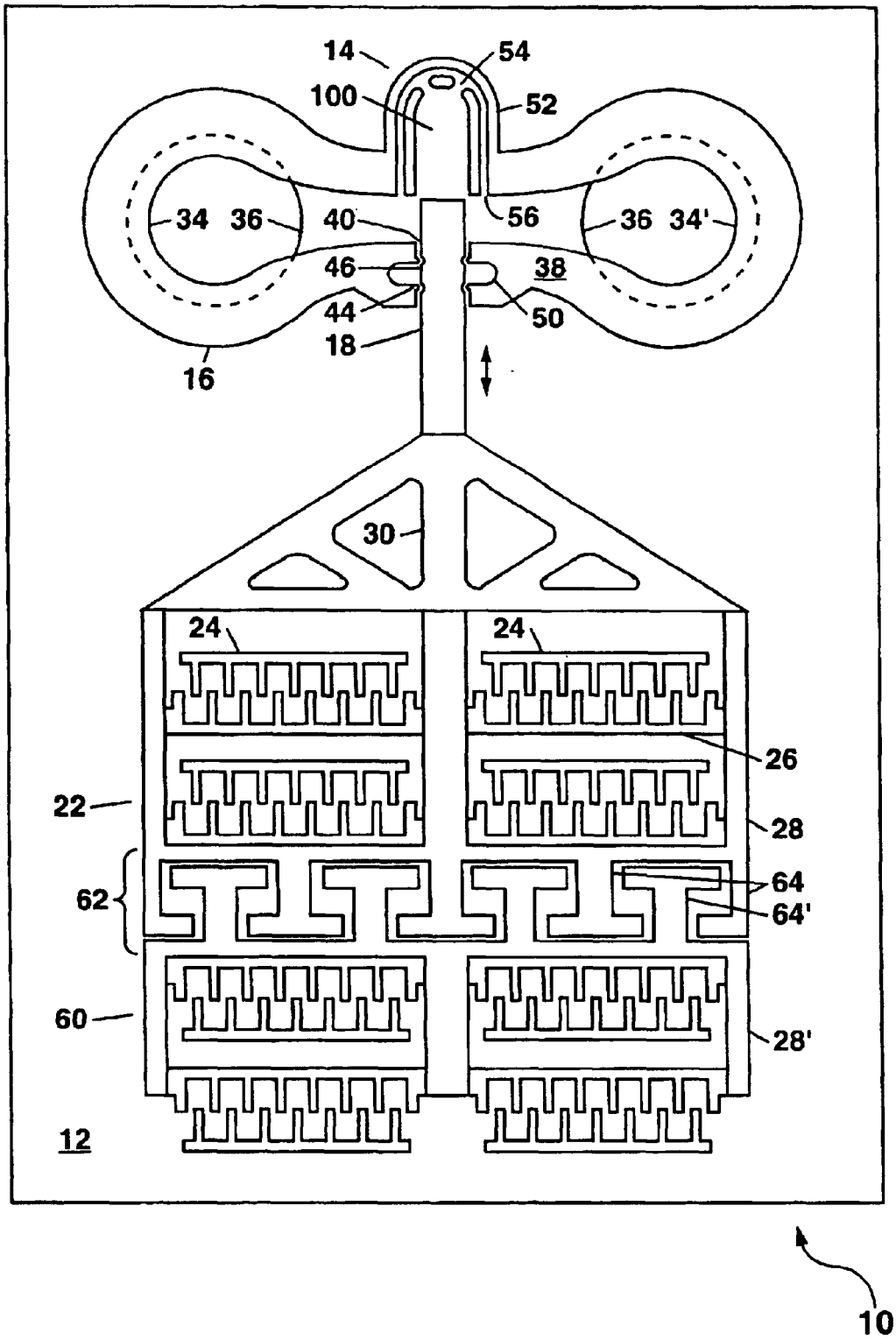
FIG. 5 shows a schematic plan view of a second example of the fluid-ejection apparatus of the present invention.

FIG. 5 schematically illustrates in plan view a second example of the fluid-ejection apparatus 10 of the present invention. In the example of FIG. 5, the top wall 42 of the fluid reservoir 16 and of the fluid-ejection chamber 14 wherein the orifice 20 is located is omitted in order to show details inside the fluid reservoir 16 and the fluid-ejection chamber 14.

In the example of FIG. 5, the fluid-ejection chamber 14 has been formed with a hollow sidewall 52 extending thereabout, with the hollow sidewall 52 having one or more openings 54 into the interior of the fluid-ejection chamber 14 to form one or more fluid communication channels 56 between the fluid reservoir 16 and the fluid-ejection chamber 14. These fluid communication channels 56 can be used in combination with a flow of the fluid 100 around the piston 18 and into the open end of the chamber 14 as previously described with reference to FIG. 1 to fill the fluid-ejection channel 14 with the fluid 100. Alternately, in other embodiments of the present invention, the fluid communication channels 56 can be used exclusively to fill the chamber 14. In these embodiments of the present invention, the piston 18 need not be moved completely out of the fluid-ejection chamber 14.

Although the openings 54 are shown in FIG. 5 located proximate to a closed end of the chamber 14 where the orifice 20 is generally located, in other embodiments of the present invention, the openings 54 can be located proximate to the open end of the chamber 14 and distal to the orifice 20. Each location of the openings 54 can be advantageous. By locating the openings 54 proximate to the open end of the chamber 14, the openings 54 can be effectively valved off by movement of the piston 18 into the chamber 14 past the openings 54. This is advantageous for limiting any back-leakage of the fluid 100 out of the chamber 14 during ejection of the portion 110 of the fluid 100 by the piston 18.

On the other hand, locating the openings 54 proximate to the closed end of the chamber 14 and the orifice 20 can be used to take advantage of any suction produced during retraction of the piston 18 to help refill the chamber 14 with the fluid 100. During a subsequent ejection of the fluid 100 in the chamber 14 by the piston 18, some fluid 100 may leak back through the openings 54 and the channel 56. This does not necessarily result in a disadvantage, however, since this back-leakage can be taken into account during design of the apparatus 10 to provide a predetermined volume for the ejected portion 110. Alternately, in other embodiments of the present invention, the back-leakage can be eliminated by forming a one-way valve in each opening 54 (e.g. a flapper valve 76 as described hereinafter with reference to a hollow piston 18 shown in FIGS. 10A and 10B).

In the second example of the present invention in FIG. 5, a first MEM actuator 22 is used to move the piston 18 forward into the fluid-ejection chamber 14; and a second MEM actuator 60 is provided on the substrate 12 to retract the piston 18. Each MEM actuator 22 and 60 operates unidirectionally, with the two MEM actuators 22 and 60 being mechanically coupled together only during retraction of the piston 18 by the second MEM actuator 60. This arrangement allows each MEM actuator 22 and 60 to be independently optimized for its particular use (i.e. to eject the portion 110 of the fluid 100, or to retract the piston 18 after ejection of the portion 110). Additionally, this arrangement allows the MEM actuator 60 to provide an impact force to the piston 18 which can be advantageous for abruptly cutting off the ejected portion 110 of the fluid 100 which can be advantageous for drop formation when the fluid 100 is viscous or when a very small drop size is required.

In FIG. 5, the two MEM actuators 22 and 60 comprise electrostatic comb actuators which are coupled together by an interlocking linkage 62 comprising a plurality of interlocking catches 64 and 64'. The catches 64 can be formed integrally with the frame 28 of the MEM actuator 22 as shown in FIG. 5; and the catches 64' can be formed integrally with a frame 28' of the MEM actuator 60. During forward movement of the piston 18 by the MEM actuator 22 (i.e. by providing an applied voltage between the stationary and moveable electrostatic combs 24 and 26 therein), the catches 64 of the linkage 62 will move forward as shown in FIG. 6, while the catches 64' remain stationary. One or more stops (not shown) can be optionally provided in the apparatus 10 to limit the forward motion of the MEM actuator 22 to prevent the catches 64 and 64' from coming into contact with each other during this forward motion so that the only contact between the catches 64 and 64' occurs during retraction of the piston 18.

Figure 7:
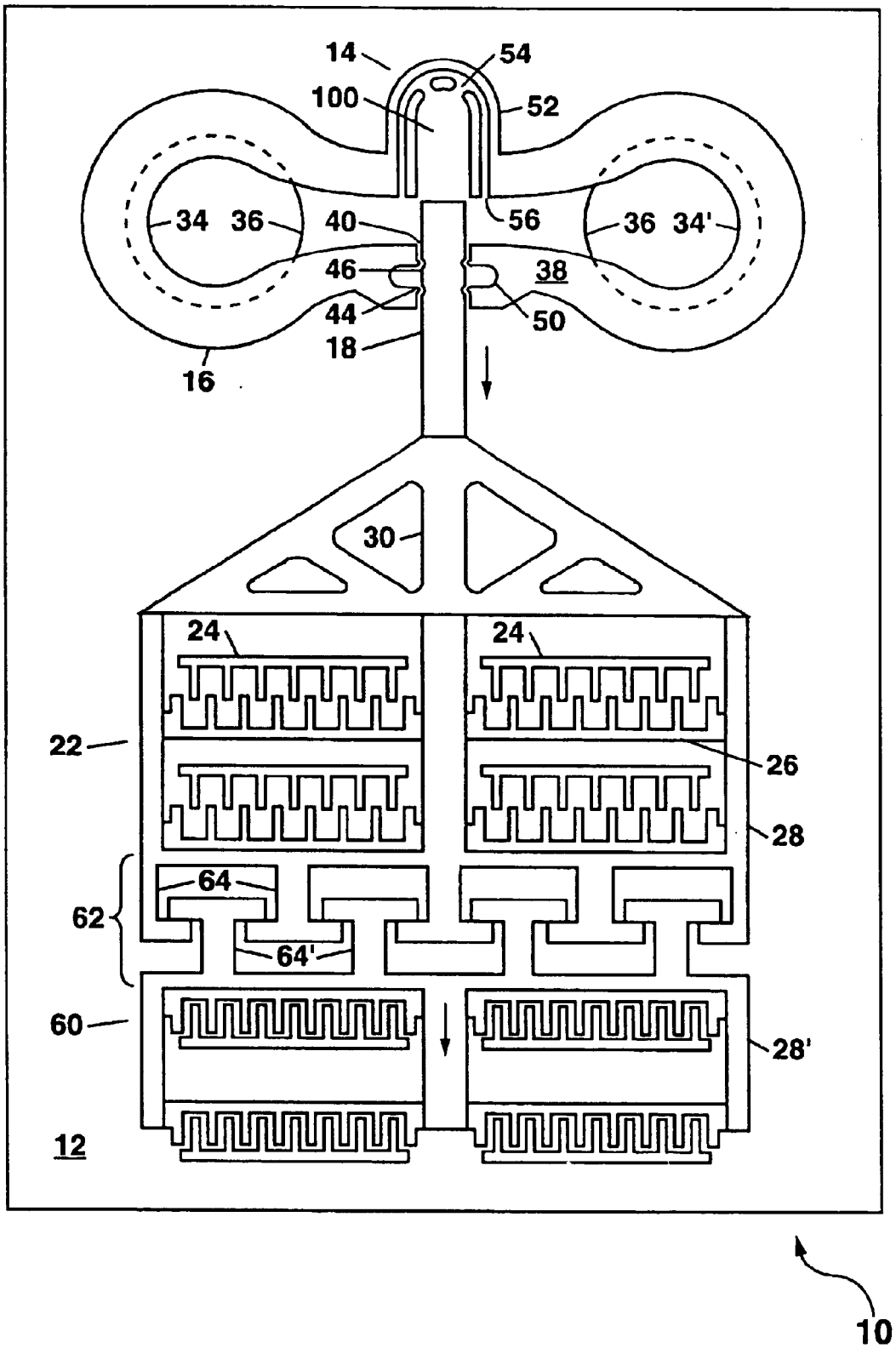
FIG. 7 illustrates operation of another electrostatic comb actuator in the apparatus of FIGS. 5 and 6 to retract the piston from the fluid-ejection chamber.

To retract the piston 18, a retraction voltage (generally in the range of 5–200 Volts) can be applied to the actuator 60, with the applied voltage to the actuator 22 being removed or reduced. The actuator 60 then moves the frame 28' and the catches 64' formed integrally therewith backwards away from the actuator 22 as shown in FIG. 7 to initially engage the catches 64 and 64', which heretofore have been separated from each other by up to a few microns, and then to retract the piston 18. The engagement of the catches 64 and 64' can provide a sudden impact force which can be advantageous as described previously. It should be noted that this impact force can be inversely related to the displacement of the piston 18 since the separation between the catches 64 and 64' at the instant the retraction voltage is applied is largest when the displacement of the piston 18 is small. This can be used to advantage to produce small-sized ejected drops with the apparatus 10 which otherwise may be difficult to separate from the orifice 20 due to surface tension.

Upon removal or reduction of the retraction voltage, a plurality of springs (not shown) underlying the frame 28' and moveable electrostatic combs attached thereto will return the actuator 60 to its initial rest position as shown in FIG. 5. Alternately, the actuator 22 can be activated to eject another jet or drop of the fluid 100, with the forward movement of the actuator 22 assisting the springs in returning the actuator 60 to its initial rest position.

The remaining elements of the second example of the present invention in FIGS. 5–7 can be as previously described with reference to FIGS. 1–4. Fabrication of the second example of the present invention can also be performed using surface micromachining as previously described with reference to FIGS. 1–4.

Figure 8:
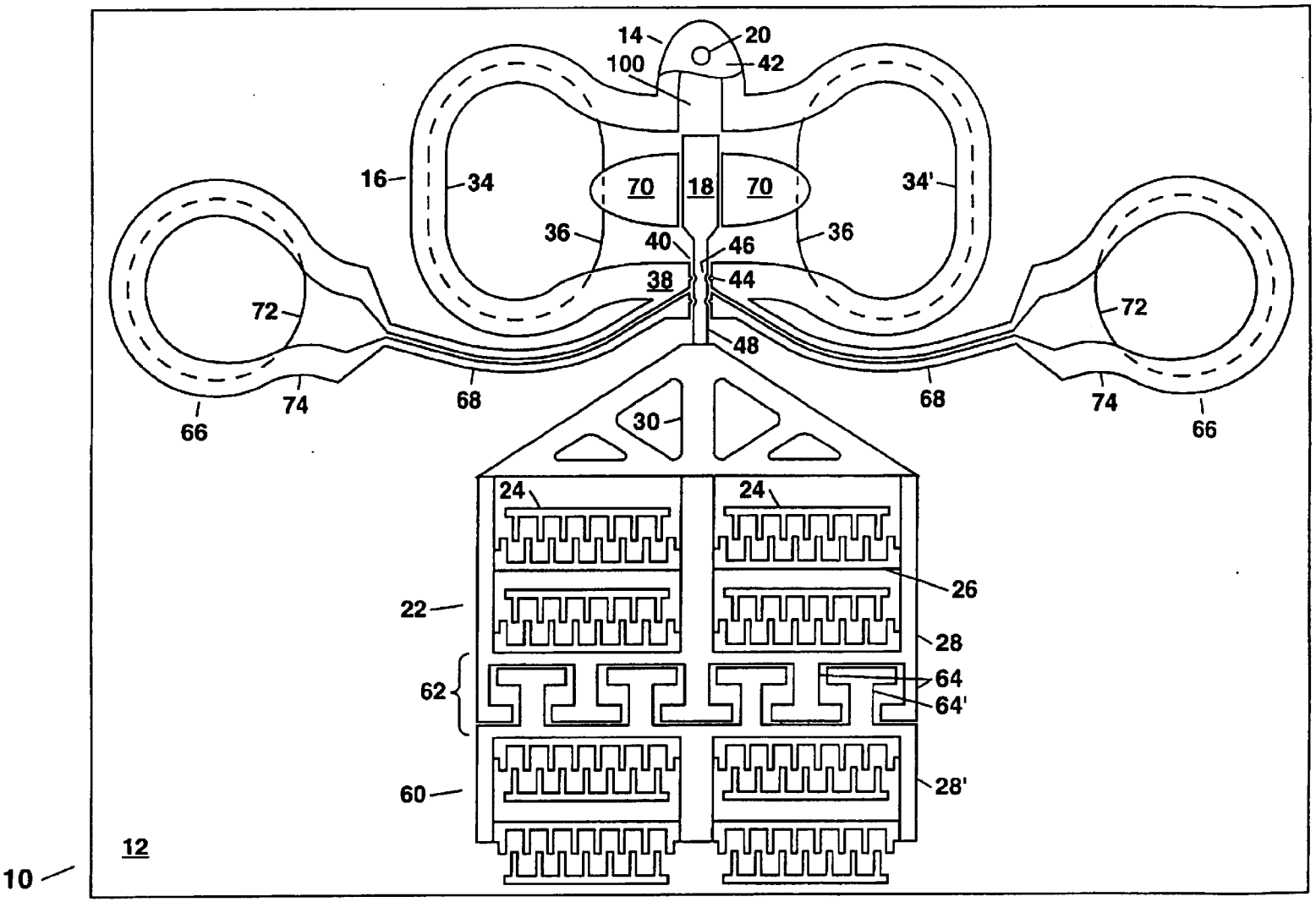
FIG. 8 shows a schematic plan view of a third example of the fluid-ejection apparatus of the present invention, with a top wall of the fluid reservoir and of the fluid-ejection chamber being removed except for a portion thereof proximate to the fluid-ejection orifice.

FIG. 8 schematically illustrates in plan view a third example of the fluid-ejection apparatus 10 of the present invention. In FIG. 8, a majority of the Poly-4 layer which forms the top walls of various fluid-containment elements including the fluid reservoir 16, the fluid-ejection chamber 14, a pair of fluid collection chambers 66 and a pair of fluid evacuation ducts 68 has been removed to better show the structure of these elements of the apparatus 10.

In FIG. 8, the MEM actuators 22 and 60 described previously with reference to FIGS. 5–7 are provided on the substrate 12 to move the piston 18 back and forth, with the piston 18 being coupled to the MEM actuator 22 through a linkage 48 which can have a different width than that of the piston 18. As an example, the linkage can be 5–10 $\mu$m wide; and the piston 18 can be 25–50 $\mu$m wide.

A pair of guides 70 formed, for example, from the Poly-1 through Poly-3 layers can be provided in the apparatus 10 as shown in FIG. 8 to help guide the piston 18 into the fluid-ejection chamber 14 and prevent any misalignment of the piston 18 which might otherwise occur (e.g. due to bending of the linkage 48 due to an uneven pressure of the fluid 100 in the two lobes 34 and 34' of the fluid reservoir 16 which might occur if two different fluids 100 are being fed into the apparatus 10 from different sources). Additionally, the guides 70 can help in contouring the lobes 34 and 34' of the fluid reservoir 16 to eliminate any "dead spots" where air or gas might become trapped and possibly restrict the flow of the fluid 100 into the chamber 14. The guides 70 also provide added support for the top wall 42 of the fluid reservoir 16.

In the example of the present invention in FIG. 8, any leakage of the fluid 100 in the opening in the sidewall 38 of the fluid reservoir 16 wherein the linkage 48 is located can be controlled and managed by a leakage control system comprising a duct 68 extending outward from the gap 40 on each side of the linkage 48 for conducting any leakage of the fluid 100 away from the gap 40. One end of each duct 68 can begin inside the gap 40 near a midpoint of the sidewall 38 as shown in FIG. 8; and the other end of each duct 68 can empty into a fluid-evacuation port 72 which extends through the substrate 12 from the fluid collection chamber 66. Any leakage of the fluid 100 in the gap 40 can be collected by the duct 68 and directed into the fluid collection chamber 66 and the fluid-evacuation port 72 via capillary action, and therefrom into a supply reservoir wherefrom the fluid 100 was originally provided, or alternately into a waste chamber. The supply reservoir or the waste chamber can be located off the substrate 12. In the former case, the fluid 100 can be recycled in the apparatus 10. A vacuum source (not shown)

can be connected to the fluid-evacuation port 72 on the backside of the substrate 12 to assist the capillary action in evacuating the leakage from the apparatus 10.

The ducts 68 and the fluid evacuation chamber 66 can be formed by surface micromachining as described previously, with these elements being built up during the build-up of the remainder of the fluid ejection apparatus 10. The ducts 68 and sidewalls 74 of the fluid evacuation chamber 66 can be built up from the Poly-0 through Poly-3 layers, with the sidewalls 74 optionally including one or more trapped layers of the sacrificial material in addition to the layers of the sacrificial material which are used to define a flow region within the ducts 68 and the fluid evacuation chamber 66. The sacrificial material defining the flow region of the ducts 68 and chamber 66 will be removed during the release etch step previously described. The flow region within each duct 64 can be, for example, 1–2 $\mu$m wide and up to about 8–9 $\mu$m high. The Poly-4 layer can be used to form a top wall for each duct 64 and for each fluid evacuation chamber 66. The fluid-evacuation ports 72 can be, for example, 50–200 $\mu$m in diameter, and can be etched through the substrate 12 from the backside thereof at the same time the fluid fill ports 36 are etched.

Figure 9:
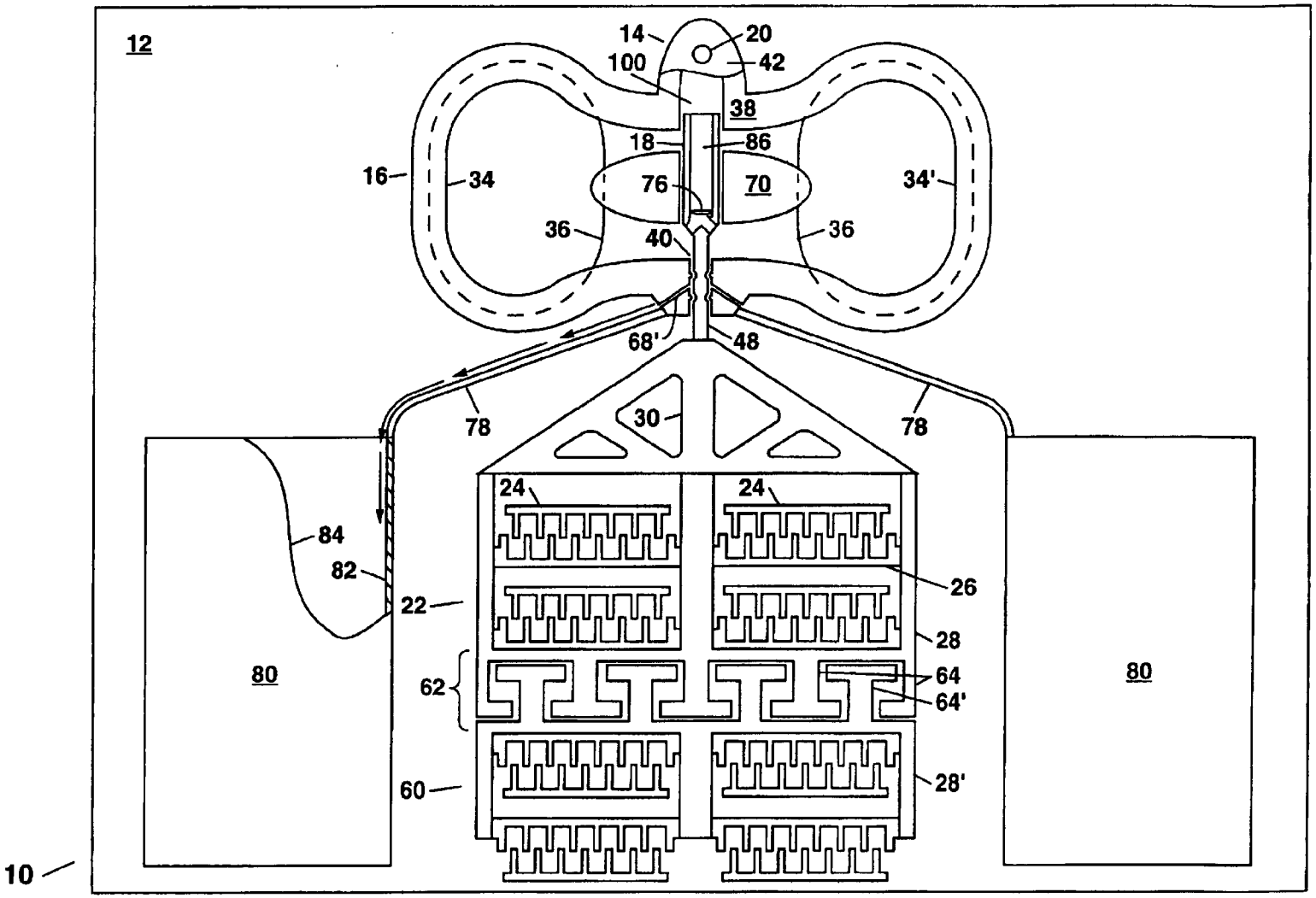
FIG. 9 shows a schematic plan view of a fourth example of the fluid-ejection apparatus of the present invention, with a top wall of the fluid reservoir and of the fluid-ejection chamber being removed except for a portion thereof proximate to the fluid-ejection orifice, and with a top layer of the piston also being removed to show details therein.

FIG. 9 shows a schematic plan view of a fourth example of the fluid-ejection apparatus 10 of the present invention which includes an alternative leakage control system and a hollow piston 18 containing a one-way flapper valve 76. The top wall 42 of the fluid reservior and of the fluid-ejection chamber is shown removed in FIG. 9 except for a portion thereof proximate to the fluid-ejection orifice 20 to better show details within these elements of the apparatus 10. Also, a top layer (i.e. the Poly-3 layer) of the hollow piston 18 has been removed in FIG. 9 to show the flapper valve 76 and other details therein.

In FIG. 9, the leakage control system comprises a pair of ducts 68' which extend outward from the gap 40 near a midpoint of the sidewall 38 and which open onto the substrate 12 proximate to a pair of flow dams 78 which are formed from a plurality of the stacked and patterned polysilicon layers (e.g. the Poly-0 through Poly-3 layers). Capillary action draws any leakage of the fluid 100 through the ducts 68' and empties the leakage at the flow dams 78 which then keeps the leakage away from the MEM actuators 22 and 60 and further channels the leakage along a flow path indicated by the straight and curved lines with arrows to finally empty the leakage into a fluid evaporation reservoir 80 wherein the leakage is retained and allowed to evaporate or solidity.

The fluid evaporation reservoir 80 comprises a plurality of sidewalls 82 formed on three sides thereof from the Poly-0 through Poly-3 layers, and a cover 84 formed from the Poly-4 layer. In FIG. 9, a part of the cover 84 has been removed to show one of the sidewalls 82 and the flow path for the leakage into the reservoir 80. The cover 84 is initially supported during fabrication thereof by a plurality of layers of the sacrificial material which are removed during the release etch step previously described. The fluid evaporation reservoir 80 can have lateral dimensions, for example, in the range of 50–300 $\mu$m and an inside thickness of about 10 $\mu$m.

In the example of the fluid-ejection apparatus 10 in FIG. 9, the piston 18 is formed with a hollow interior portion 86 and with openings in one or more sidewalls thereof and at an end thereof proximate to the fluid-ejection chamber 14 to provide a fluidic connection between the fluid reservoir 16 and the chamber 14. Operation of the hollow piston 18 can be understood with reference to FIGS. 10A and 10B which show schematic plan views of the piston 18 with a top layer (i.e. the Poly-3 layer) thereof removed to show a flapper valve 76 therein.

Figure 10A:
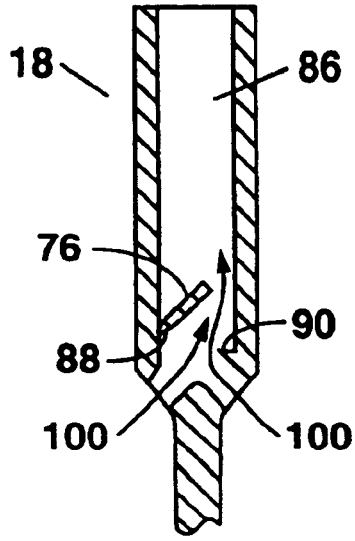
FIGS. 10A and 10B show enlarged plan views of a hollow piston in the apparatus of FIG. 9 with the top layer of the piston removed to illustrate operation of a flapper valve therein for providing a fluidic connection through the piston and between the fluid reservoir and the fluid-ejection chamber shown in FIG. 9.

In FIG. 10A, the flapper valve 76 can open to admit the fluid 100 into the piston 18 and therefrom into the fluid-ejection chamber 14 when the piston 18 is stationary and the fluid 100 in the reservoir 16 is pressurized, or when the piston 18 is being retracted. The flapper valve 76, which can be formed from the Poly-2 or Poly-3 layers, is attached to a sidewall of the piston 18 by a thin (~1 $\mu$m wide) hinge 88 formed from the same Poly-2 or Poly-3 layers as the remainder of the flapper valve 76. The hinge 88 allows the flapper valve 76 to open, and this allows a flow of the fluid 100 past the valve 76 as indicated by the lines with arrows in FIG. 10A.

Figure 10B:
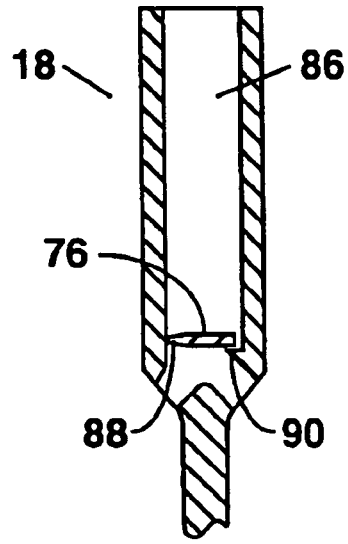

In FIG. 10B, the flapper valve 76 can close against a stop 90 to prevent any back-leakage of the fluid 100 when the fluid 100 in the chamber 14 is being ejected by a forward motion of the piston 18. The interior hollow portion 86 of the piston 18, which forms a flow channel for the fluid 100, can have lateral dimensions of, for example, 2–3 $\mu$m high by 5–40 $\mu$m wide, with the exact width of the interior portion 86 depending upon an overall width of the piston 18. The use of a hollow piston 18 can be advantageous for embodiments of the present invention wherein the piston 18 is not fully retracted from the chamber 14.

Figure 11:
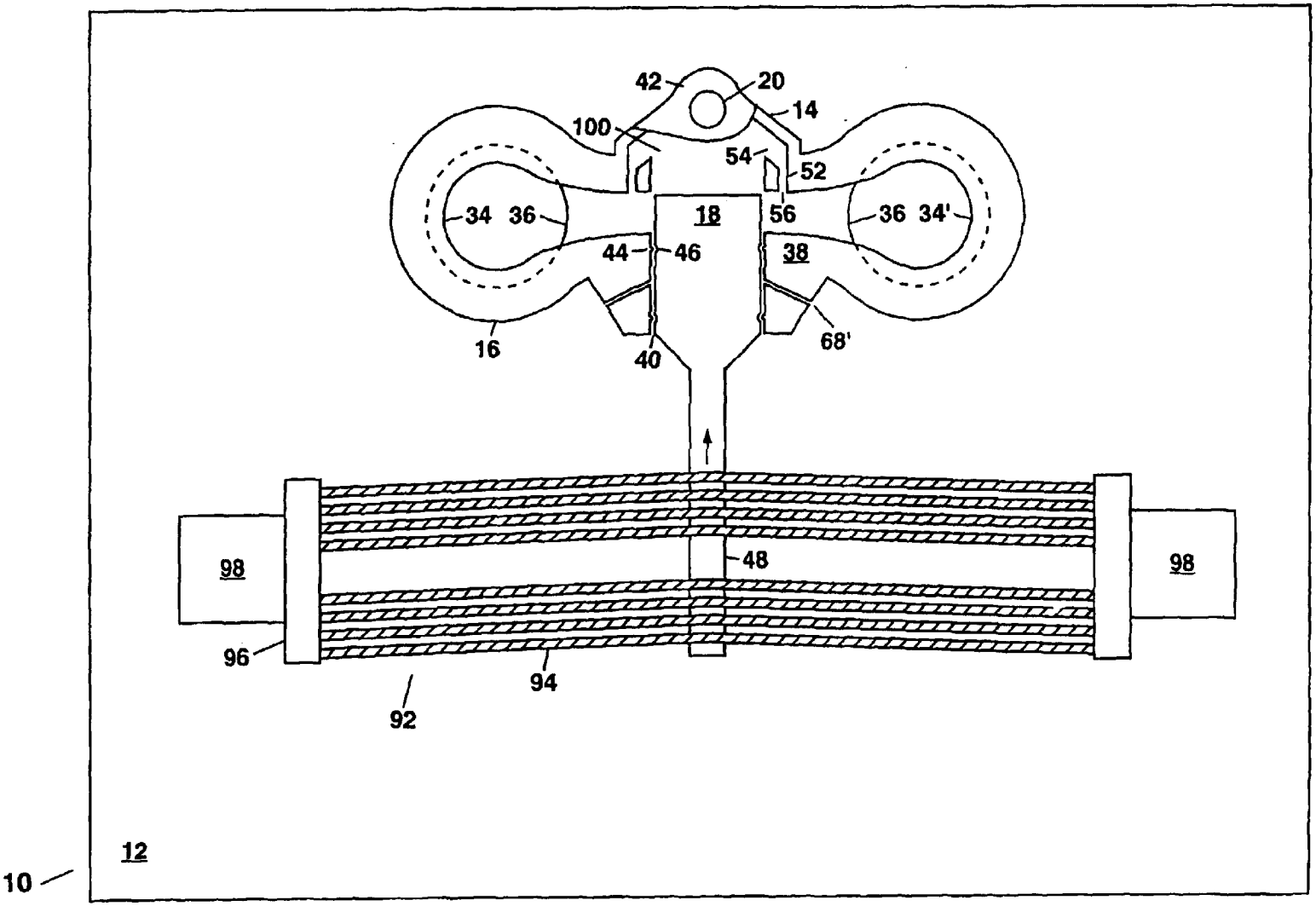
FIG. 11 shows a schematic plan view of a fifth example of the fluid-ejection apparatus of the present invention, with a top wall of the fluid reservoir and of the fluid-ejection chamber being removed except for a portion thereof proximate to the fluid-ejection orifice.

FIG. 11 shows a schematic plan view of a fifth example of the fluid-ejection apparatus 10 of the present invention which includes a MEM thermal actuator 92 for moving the piston 18 and ejecting a jet or drop of the fluid 100. In FIG. 11, the top wall 42 has been largely removed except near the orifice 20 to show details of this example of the apparatus 10. In this example of the present invention, the orifice 20 can be 20 $\mu$m in diameter; and the piston 18 can be 50 $\mu$m wide.

In FIG. 11, the fluid-ejection chamber 14 comprises hollow sidewalls 52 to provide fluid communication channels 56 on either side of the piston 18 as described previously with reference to FIG. 5, with each channel 56 having an opening 54 into the interior of the fluid-ejection chamber 14. The channels 56 can be made with lateral dimensions smaller than the orifice 20 to limit any back-leakage of the fluid 100 during ejection of the portion 110 thereof. Alternatively, a flapper valve (not shown) can be provided in each opening 54 to close and restrict the back-leakage when the piston 18 is urged forward into the chamber 14 for ejection of the portion 110 of the fluid 100 through the orifice 20 as a jet or drop.

Any leakage of the fluid 100 around the piston 18 can be controlled by providing a plurality of ridges 44 in the sidewalls 38 and valleys 46 in the sides of the piston 18 as described previously, and by further providing a duct 68' in the sidewall 38 on either side of the piston 18. In FIG. 11, each duct 68' conducts any leakage of the fluid 100 in the gap 40 via capillary action and empties the leakage onto the substrate 12 for evaporation or solidification thereof.

In the example of FIG. 11, the thermal actuator 92 comprises a bent-beam thermal actuator 92 having a plurality of beams 94 which are suspended above the substrate 12 by a pair of supports 96, with one of the supports 96 being attached to each end of each beam 94. Each beam 94 is attached at a midpoint thereof to the linkage 48. Each beam 94 is bent slightly in a preferred direction of movement (indicated by the arrow) so that when an electrical current is passed through the beams 94 to resistively heat the beams 94, the beams 94 will expand in the direction of movement and thereby move the piston 18 into the chamber 14. The electrical current is provided to the beams 94 through a pair of bond pads 98 which are electrically connected to the beams 94 through the supports 96. The bond pads 98 can be formed in the Poly-0 layer with or without an overlying metal layer. The beams 94 can be formed, for example, from the Poly-1 through Poly-4 layers, with a plurality of dimples generally being formed on an underside of each beam 94 from the Poly-1 layer to allow the beams 94 to move with minimal friction or adhesion to the substrate 12. The supports 96 can be formed from the Poly-0 through Poly-4 layers. The linkage 48 and piston 48 in FIG. 11 can be formed from the Poly-1 through Poly-3 layers as previously described. Fabrication of this example of the fluid-ejection apparatus 10 can proceed as previously described with reference to other examples of the apparatus 10, with each element in the apparatus 10 of FIG. 11 being simultaneously built-up by surface micromachining, and with the various layers of the sacrificial material being removed by a release etch step to complete fabrication of the device 10.

The provision of the plurality of bent beams 94 in FIG. 11 provides a forward movement of the linkage 48 and piston 18 which is amplified compared to the thermal expansion of each beam 94 upon heating. This can provide a displacement of the piston 18 in excess of up to several tens of microns, with the exact displacement being dependent upon the electrical current applied to the actuator 92 and a desired size for the ejected portion 110 of the fluid 100. In general, the electrical current can be up to about 50 mA, at a voltage of up to about 30 volts. The voltage can be applied symetrically across the thermal actuator 92 so that the voltage at midpoint of the beams 94 is approximately zero. This can be done by providing a positive voltage (e.g. +15 volts) to one bond pad 98 and a negative voltage (e.g. −15 volts) to the other bond pad 98. This can be advantageous when the piston 18 is electrically grounded. Alternately, one or more layers of silicon nitride can be used to electrically the piston 18 or the linkage 48 from the beams 94. Upon removal of the electrical current through the beams 94, the beams 94 will quickly cool down and contract back to their original size, thereby retracting the piston 18 back from the fluid-ejection chamber 14.

Other applications and variations of the present invention will become evident to those skilled in the art. In other embodiments of the present invention, the fluid-ejection apparatus 10 can be formed with a single lobe 34 (e.g. when a single fluid 100 is to be used in the apparatus 10), or with more than two lobes 34 (e.g. when multiple fluids 100 are to be mixed in the apparatus 10 prior to ejection therefrom). Additionally, in other embodiments of the present invention, other types of MEM actuators can be substituted for the electrostatic comb actuators 22 and 60 described herein. As an example, a capacitively-coupled electrostatic plate actuator as disclosed in U.S. Pat. No. 6,507,138, which is incorporated herein by reference, can be used in other embodiments of the present invention to replace one or both of the actuators 22 and 60. The capacitively-coupled electrostatic plate actuator can be formed as a unidirectional actuator, or as a bidirectional actuator. Furthermore, the capacitively-coupled electrostatic plate actuator can include a displacement multiplier as disclosed in U.S. Pat. Nos. 6,507,138 and 6,175,170, which are incorporated herein by reference, if this is needed to provide a required displacement for the piston 18.

Multiple fluid-ejection devices 10 can be formed on a common substrate 12 and arranged as a one- or two-dimensional array. Such an arrangement is useful for providing a plurality of ejected jets or drops of one or more fluids 100 onto a surface, with the ejected jets or drops being directed to the same or to different locations on the surface. In some embodiments of the present invention, a common fluid reservoir 16 can be used to provide the fluid 100 to multiple fluid-ejection chambers 14 each with its own piston 18 and MEM actuator 22.

Although the fluid-ejection apparatus 10 of the present invention does not produce any electric field within the fluid reservoir 16 or the fluid-ejection chamber 14, an electric field can be provided in certain embodiments the fluid-ejection apparatus 10 outside of the reservoir 16 or chamber 14 to influence or modify characteristics of the ejected portion 110 of the fluid 100. Thus, for example, an electric field can be produced by one or more electrodes located above the orifice 20 to electrostatically charge the ejected portion 110 of the fluid 100 in order to improve adhesion of the portion 110 to a particular surface whereon the portion 110 is to be deposited.

The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A surface-micromachined fluid-ejection apparatus, comprising:

(a) a substrate;

(b) an open-ended cylindrical fluid-ejection chamber formed on the substrate and further comprising a plurality of stacked and patterned layers of polycrystalline silicon, with the fluid-ejection chamber being adapted to receive a fluid, and with the fluid-ejection chamber further having a fluid-ejection orifice formed through a wall thereof at a location distal to an open end of the fluid-ejection chamber; and (c) a piston formed on the substrate and moveable in the plane of the substrate from a first position outside the fluid-ejection chamber to a second position inside the fluid-ejection chamber to eject a jet or drop of the fluid through the orifice.

2. The apparatus of claim 1 further comprising a microelectromechanical actuator formed on the substrate and operatively connected to move the piston between the first and second positions.

3. The apparatus of claim 2 wherein the actuator comprises an electrostatic actuator.

4. The apparatus of claim 3 wherein the electrostatic actuator comprises a bidirectional electrostatic actuator to provide a reciprocating motion to the piston.

5. The apparatus of claim 2 wherein the actuator comprises a thermal actuator.

6. The apparatus of claim 5 wherein the thermal actuator comprises a bent-beam thermal actuator.

7. The apparatus of claim 2 further including another microelectromechanical actuator operatively connected to retract the piston after ejection of the fluid.

8. The apparatus of claim 1 wherein the substrate comprises silicon.

9. The apparatus of claim 1 wherein the piston comprises polycrystalline silicon.

10. The apparatus of claim 1 further including a fluid reservoir in fluidic communication with the fluid-ejection chamber for providing the fluid thereto.

11. The apparatus of claim 10 wherein the fluid-ejection chamber includes an opening through a sidewall thereof to provide a pathway for the fluid to enter the fluid-ejection chamber.

12. The apparatus of claim 11 wherein the sidewall of the fluid-ejection chamber is hollow and forms a fluid communication channel between the fluid reservoir and the fluid-ejection chamber.

13. The apparatus of claim 10 further including a fluid fill port formed through the substrate for supplying the fluid to the fluid reservoir.

14. The apparatus of claim 10 wherein the piston is located, at least in part, inside the fluid reservoir, and a microelectromechanical actuator is located outside the fluid reservoir.

15. The apparatus of claim 14 wherein the piston is connected to the actuator by a linkage which penetrates through an opening in a sidewall of the fluid reservoir.

16. The apparatus of claim 15 wherein the opening in the sidewall of the fluid reservoir further includes an indentation opposite each side of the linkage to provide a gas-bubble seal between the linkage and the fluid reservoir to limit a leakage of the fluid through a gap separating the linkage and the opening in the sidewall of the fluid reservoir.

17. The apparatus of claim 15 further including means for collecting any leakage of the fluid through a gap separating the linkage and the opening in the sidewall of the fluid reservoir.

18. The apparatus of claim 17 wherein the means for collecting the leakage comprises a duct extending outward from the gap for conducting any leakage of the fluid away from the gap.

19. The apparatus of claim 18 wherein the duct empties into a fluid evacuation port formed through the substrate.

20. The apparatus of claim 18 wherein the duct empties into a fluid evaporation tank formed on the substrate.

21. The apparatus of claim 1 wherein the fluid-ejection orifice has a diameter of 50 microns or less.

22. The apparatus of claim 1 wherein the fluid-ejection chamber comprises an electric-field-free region, with the piston and fluid-ejection chamber both being maintained at a ground electrical potential during ejection of the jet or drop of the fluid.

23. A surface-micromachined fluid-ejection apparatus, comprising:

(a) a substrate;

(b) an open-ended fluid-ejection chamber formed on the substrate from a plurality of stacked and patterned layers of polycrystalline silicon, with the fluid-ejection chamber being adapted to receive a fluid, and with the fluid-ejection chamber further having a fluid-ejection orifice formed through a wall thereof;

(c) a fluid reservoir formed on the substrate from the plurality of stacked and patterned layers of polycrystalline silicon and connected to the fluid-ejection chamber to supply the fluid thereto;

(d) a piston formed on the substrate and moveable in the plane of the substrate to eject a jet or drop of the fluid through the fluid-ejection orifice; and (e) at least one microelectromechanical actuator formed on the substrate and operatively connected to provide reciprocating motion to the piston, with the microelectromechanical actuator being located outside the fluid reservoir and outside the fluid-ejection chamber.

24. The apparatus of claim 23 wherein a fluidic connection between the fluid reservoir and the fluid-ejection chamber is provided through the piston.

25. The apparatus of claim 24 wherein the fluidic connection comprises a hollow portion of the piston and a flapper valve formed within the piston.

26. The apparatus of claim 23 wherein a fluidic connection between the fluid reservoir and the fluid-ejection chamber is provided through a hollow sidewall of the fluid-ejection chamber.

27. The apparatus of claim 23 wherein a fluidic connection between the fluid reservoir and the fluid-ejection chamber is provided through a spacing between the piston and an open end of the fluid-ejection chamber when the piston is in a retracted position.

28. The apparatus of claim 23 wherein a mechanical connection between the microelectromechanical actuator and the piston is made through an opening in the sidewall of the fluid reservoir.

29. The apparatus of claim 28 wherein the opening in the sidewall of the fluid reservoir further includes an indentation opposite each side of the linkage to provide a gas-bubble seal between the linkage and the fluid reservoir to limit a leakage of the fluid through a gap separating the linkage and the opening in the sidewall of the fluid reservoir.

30. The apparatus of claim 28 further including means for collecting any leakage of the fluid through a gap separating the linkage and the opening in the sidewall of the fluid reservoir.

31. The apparatus of claim 30 wherein the means for collecting the comprises a duct extending outward from the gap for conducting any leakage of the fluid away from the gap.

32. The apparatus of claim 31 wherein the duct empties into a fluid evacuation port formed through the substrate.

33. The apparatus of claim 31 wherein the duct empties into a fluid evaporation tank formed on the substrate.

34. The apparatus of claim 23 wherein the substrate comprises silicon, and the piston comprises polycrystalline silicon.

35. A surface-micromachined fluid-ejection apparatus, comprising:

(a) a substrate;

(b) an open-ended fluid-ejection chamber formed on the substrate, with the fluid-ejection chamber forming an electric-field-free region whereby a fluid disposed therein is not contacted by any electric field produced by the apparatus, and with the fluid-ejection chamber further having a micron-sized fluid-ejection orifice formed through a top wall thereof;

(c) a fluid reservoir formed on the substrate and connected to the fluid-ejection chamber to supply the fluid thereto;

(d) a piston formed on the substrate and moveable in the plane of the substrate to eject a portion of the fluid through the fluid-ejection orifice; and (e) at least one microelectromechanical actuator formed on the substrate outside the fluid reservoir and operatively connected to provide reciprocating motion to the piston.

36. The apparatus of claim 35 wherein the substrate comprises monocrystalline silicon, and each of the fluid-ejection chamber, the fluid reservoir, the piston and the microelectromechanical actuator comprise polycrystalline silicon.

37. The apparatus of claim 35 wherein the piston is connected to the microelectromechanical actuator by a linkage which penetrates through an opening in a sidewall of the fluid reservoir.

38. The apparatus of claim 37 wherein the opening in the sidewall of the fluid reservoir further includes an indentation opposite each side of the linkage to provide a gas-bubble seal between the linkage and the fluid chamber to limit a leakage of the fluid through a gap separating the linkage and the opening in the sidewall of the fluid reservoir.

39. The apparatus of claim 37 further including means for collecting any leakage of the fluid through a gap separating the linkage and the opening in the sidewall of the fluid reservoir.

40. The apparatus of claim 39 wherein the means for collecting the leakage comprises a duct extending outward from the gap for conducting any leakage of the fluid away from the gap.

41. The apparatus of claim 40 wherein the duct empties into a fluid evacuation port formed through the substrate.

42. The apparatus of claim 40 wherein the duct empties into a fluid evaporation tank formed on the substrate.

* * * * *